United States Patent [19]

Crum

[11] 4,050,928

[45] Sept. 27, 1977

[54] CORROSION-RESISTANT MATRIX-STRENGTHENED ALLOY

[75] Inventor: James Roy Crum, Ona, W. Va.

[73] Assignee: The International Nickel Company, Inc., New York, N.Y.

[21] Appl. No.: 658,227

[22] Filed: Feb. 17, 1976

[51] Int. Cl.[2] ..... C22C 30/02; C22C 38/06; C22C 38/42

[52] U.S. Cl. ..... 75/124; 75/122; 75/125; 75/128 E; 148/31; 148/37

[58] Field of Search ..... 75/122, 124, 125, 128 R, 75/128 E; 148/38, 37, 31

[56] References Cited

U.S. PATENT DOCUMENTS

| | | | |
|---|---|---|---|
| 2,553,330 | 5/1951 | Post | 75/122 |
| 3,303,023 | 2/1967 | Dulis et al. | 75/124 |
| 3,362,813 | 1/1968 | Ziolkowski | 75/125 |
| 3,674,468 | 7/1972 | Ota | 75/125 |
| 3,811,875 | 5/1974 | Goda, Jr. et al. | 75/125 |
| 3,837,846 | 9/1974 | Becker et al. | 75/128 E |
| 3,900,316 | 8/1975 | Forbes Lener | 75/125 |
| 3,926,620 | 12/1975 | Kowaka | 75/125 |
| 3,989,514 | 11/1976 | Fujioka | 75/128 E |

*Primary Examiner*—Arthur J. Steiner
*Attorney, Agent, or Firm*—George N. Ziegler; Ewan C. MacQueen

[57] ABSTRACT

Iron-based alloy composition containing special proportions of nickel, chromium, aluminum, copper and carbon provides good corrosion-resistance characteristics for service in caustic media, e.g., sodium hydroxide, chloride media, e.g., magnesium chloride, caustic-chloride media, e.g., sodium hydroxide-sodium chloride mixtures, and also when exposed to some acid media, e.g., nitric acid. Special utility particularly includes resistance to stress-corrosion-cracking in hot caustic and chloride media. Alloy has good workability for production of wrought products such as plate, bar and sheet and is also suitable for making corrosion-resistant castings and welded structures, e.g., chemical plant equipment.

11 Claims, No Drawings

CORROSION-RESISTANT MATRIX-STRENGTHENED ALLOY

The present invention relates to iron-base alloys, particularly including corrosion resistant nickel-chromium alloys based on iron.

In the chemical industry, power industry and other fields there are needs for alloys having good resistance to corrosion by the special industrial environments of the industries while also providing desirable strength and ductility and having fabricating characteristics suitable for commercial production of industrial plant equipment. Moreover, costs, including metal costs and production costs, are important and often decisive factors in determining whether an alloy is satisfactory for a commercial need, such as in industrial plant equipment. Generally, for these needs, alloys based on iron, wherein the proportion of iron is larger than that of any other ingredient, are advantageous, particularly from the viewpoint of low cost, and, in at least some instances, for strength or fabricability. In the chemical industry and elsewhere there are needs for low-cost alloy products and articles having resistance to various special caustic, chloride or acid environments. Important special corrosion resistant characteristics particularly include, in addition to satisfactory resistance to general and intergranular corrosion in alkaline and some acid environments, needs for metal products that resist stress-corrosion-cracking in environments containing caustic and/or chlorides. And, especially for industrial use, tolerance for contaminants, e.g., sulfur, is desirable.

Needs for corrosion resistant alloys are too numerous and various to be completely metioned here. In some instances of chemical plant environments, stress-corrosion-cracking resistance is needed to overcome problems where metals effectively resist general corrosion but, however, fail by stress-corrosion cracking. And for some services an article of plant apparatus faces different kinds of corrosive media against different portions and needs a variety of corrosion-resistant characteristics. For instance, a heat exchanger tube may have sodium hydroxide or sodium hydroxide-sodium chloride solutions on one side and industrially contaminated steam on the other side, and in service the tube is subjected to temperature variations from room temperature to steam temperatures, sometimes as high as 600° F., or higher.

There has now been discovered an iron-base alloy having, inter alia, desirable characteristics for chemical plant service in industrial caustic environments and other special environments.

It is an object of the invention to provide a corrosion-resistant iron-base alloy and corrosion-resistant iron-base articles and wrought products.

Other objects and advantages of the invention will become apparent from the following description.

The present invention contemplates an iron-base alloy and products thereof containing (by weight) 18% to 30% nickel and 20% to 30% chromium in correlated proportions having a Ni/Cr ratio not greater than about 0.9 or up to 1.0, 1.7% to about 3% aluminum, advantageously 1.7% to 2.2% aluminum, 1% to about 5% copper, advantageously 1% to 1.8% copper, 0.03% to 0.08% carbon, up to about 1.5% manganese, up to 0.06% calcium and balance essentially iron in an amount of at least 44% of the alloy. Advantageously, especially for good resistance to stress-corrosion cracking in caustic media, the alloy is proportioned to have a Ni/Cr ratio of 0.6 to 0.8, e.g., 18% nickel with 22.5% chromium. It is desirable to have small amounts of calcium and manganese, such as 0.03% to 0.06% calcium and 0.4% to 1.5% manganese, in the alloy in order to benefit deoxidation and malleability. Products of the alloy particularly include annealed wrought products having a stress-corrosion resistant multiphase microstructure.

Although the alloy may contain other elements in small amounts, such as up to 0.2% columbium (and/or tantalum), up to about 0.75% titanium and up to 0.6% silicon, possibly from impurities in melt charge ingredients, which may include scrap, other elements should be restricted to lower levels insofar as is practical.

Excessive amounts of molybdenum and silicon are especially avoided in order to safeguard resistance to stress-corrosion-cracking (SCC resistance). Experimental compositions containing 3% molybdenum and/or 1.4% silicon showed increased SCC susceptibility in caustic. Moreover, compositions containing 0.3% to 0.5% molybdenum (annealed at 1800° F.) were found to have decreased resistance to stress-corrosion-cracking in magnesium chloride solution. Though much more resistant to cracking than ordinary austenitic stainless steels, these compositions did fail by the end of the 720 hour test period. For benefiting resistance to chloride stress-corrosion-cracking, any presence of molybdenum is advantageously maintained not greater than 0.2%.

Sulfur should be maintained low, desirably not higher than 0.01%, to prevent hot working and welding difficulties.

And, in general, the aggregate total of any elements other than nickel, chromium, copper, aluminum and iron is desirably restricted to not exceed 3.8% of the alloy.

The alloy of the invention has at least 1.7% aluminum and about 1% copper along with nickel and chromium in the aforestated correlated proportions in order to provide desired corrosion resistance, particularly including resistance to general corrosion in caustics and in acids and resistance to stress-corrosion-cracking in hot caustic and/or chloride media along with satisfactory mechanical, metallurgic and fabricability properties, e.g., strength, ductility, toughness, hot and cold workability and weldability.

Excessive aluminum reduces ductility and formability. Excessive amounts of copper unnecessarily add to cost and have been detrimental to stress-corrosion-cracking resistance. Control to not more than 2.2% aluminum and not more than 1.8% copper is particularly advantageous for benefiting fabricability and saving expense.

Chromium in excess leads to cold working difficulties and chromium is advantageously not above 28%.

As a particularly important feature of the invention it is noted that the alloy proportions of nickel, chromium, aluminum, copper and other elements, e.g., carbon, iron and impurities, controlled as set forth here, provide specially good resistance to stress-corrosion-cracking when in the multiphase microstructural condition that is achieved when the alloy is annealed at 1800° F. after cold working. The multiphase structure has an austenitic matrix phase, a discontinuous lamellar second phase and a third phase of irregular particles randomly distributed throughout the matrix.

Presence of carbon in the restricted range of 0.03% to 0.08% aids the corrosion-resistant microstructure and mechanical properties.

Proportioning of the alloy to have a Ni/Cr ratio not greater than 0.8, such as nickel-to-chromium percentage ratios of 0.6 to 0.8, provides desirable electrochemical potentials in caustic and from this viewpoint alloy compositions of the invention with 18% to 24% nickel and 22.5% to 30% chromium are advantageous.

For carrying the invention into practice reliably on a commercial scale, a specially restricted compositional range of 18% to 20% nickel, 25% to 28% chromium, 1.7% to 2.2% aluminum, 1% to 1.8% copper, 0.03% to 0.08% carbon, up to 1.5% manganese, up to 0.6% silicon and balance iron, and a production aim to 19% nickel, 26% chromium, 2% aluminum, 1.4% copper, 0.75% manganese, 0.3% silicon and about 50% iron, are advantageous for consistently achieving the desired results of corrosion-resistance, strength and fabricability, particularly including weldability. Calcium should be added as a deoxidant, particularly for production workability.

The alloy can be prepared by melt practices known to be satisfactory for producing low carbon stainless steels and can be hot worked, cold worked or cast-to-shape for production of wrought products, e.g., plate, sheet, strip bar or wire, or forged or cast articles. Forging temperatures of at least 2200° F. are recommended, since hot working difficulties were encountered when lower forging temperatures were tried. A hot-worked condition anneal of ½ hour at 1950° F/. followed by air cooling, is recommended for preparing the hot-worked alloy for cold rolling.

After cold-working, it is advantageous for corrosion resistance to place the alloy in the multiphase condition obtained by a final anneal of heating at about 1800° F. for about ¼ to ½ hour, or possibly less, and air cooling therefrom to room temperature. Recommended practical ranges for final annealing in production are heating at about 1800° F. to 1850° F. for about ¼ to ½ hour. The final annealing atmosphere can be in air or some other, essentially inert, non-carburizing, non-nitriding, atmosphere. The air cooling recommended herein refers to normal air cooling rates such as with sections about 1/16 inch to 1 inch thick.

For the purpose of giving those skilled in the art a better understanding of the invention and the advantages thereof, the following illustrative examples are given.

EXAMPLE I

A furnace charge of pellet nickel, low-carbon ferrochrome and a small amount of high-carbon ferrochrome, and iron was air-induction melted, then copper and aluminum additions were made for an iron-base alloy in accordance with the invention. The melt was deoxidized with calcium and cast to ingot form. Titanium was included in the melt in order to represent possible presence of titanium in the event that melts are made using scrap from other alloys. Results of chemical analysis of the ingot metal (alloy 1) are set forth in the following Table I. The alloy was hot forged, then hot-rolled to plate, and thereafter cold rolled 50% (reduction in thickness) to provide strip about 0.125-inch thick. Forging temperature was 2200° F.; hot-worked anneal prior to cold rolling was at 1950° F., and the final anneal of the cold rolled strip was ½ hour at 1800° F., followed by air cooling which placed the strip product of alloy 1 in the corrosion-resistant multiphase condition. Satisfactory corrosion resistance and mechanical properties of the thus-produced product of alloy 1 were confirmed by corrosion test results and mechanical test results set forth in tables hereinafter.

EXAMPLE II

In another example, an ingot of alloy 2 was prepared by air-induction melting a furnace charge of pellet nickel and other alloy ingredients of the kind used in Example I in proportions for an alloy contains 18–20% nickel, 25–28% chromium, 1.7–2.2% aluminum, 1.0–1.8% copper, about 0.05% carbon and balance essentially iron, and casting into an ingot mold. The ingot metal was hot worked, cold worked and heat treated according to the processing of alloy 1. Corrosion tests and mechanical tests confirmed that the resulting cold-rolled plus 1800° F.-annealed strip(product 2 of alloy 2) was highly satisfactory for corrosion resistant apparatus. Results of chemical analysis and testing are set forth in tables hereinafter.

Further, the invention is also exemplified by chemical analyses and test results pertaining to alloys 3, 4 and 5 referred to in the following tables and text.

Recrystallized grain size of the 1800° F-annealed strip, and also of strip given a high-temperature anneal at 2000° F, was of the order of ASTM 8 to 10. Both the 1800° F and the 2000° F anneals are good for resistance to general corrosion. The 1800° F-annealed is advantageous for stress-corrosion-cracking resistance and is especially required for overcoming stress-corrosion-cracking in chloride media, e.g., boiling magnesium chloride solutions.

TABLE I

| | Chemical Composition (Percent by Weight) | | | | | | | | | | |
|---|---|---|---|---|---|---|---|---|---|---|---|
| Alloy | % Ni | % Cr | % Al | % Cu | % C | % Mn | % Si | % Ti | % Mo | % Fe | Ni/Cr |
| 1 | 20.66 | 24.71 | 2.98 | 1.09 | 0.05 | 0.84 | 0.33 | 0.50 | 0.09 | Bal | 0.834 |
| 2 | 19.44 | 27.67 | 2.16 | 1.42 | 0.05 | 0.85 | 0.40 | 0.48 | 0.098 | " | 0.702 |
| 3 | 20.77 | 25.09 | 2.91 | 2.97 | 0.06 | 0.83 | 0.30 | 0.46 | 0.10 | " | 0.828 |
| 4 | 22.34 | 25.87 | 1.86 | 0.98 | 0.04 | 0.75 | 0.37 | 0.45 | 0.11 | " | 0.864 |
| 5 | 21.22 | 26.06 | 1.73 | 2.82 | 0.04 | 0.76 | 0.31 | 0.47 | 0.10 | " | 0.814 |

Bal. - Balance
Sulfur content about 0.006% to 0.009%

Stress-corrosion-cracking tests were performed with standard U-bend speciments made from 0.125-inch thick strip in the cold rolled plus 1800° F.-annealed condition, except where referred to otherwise. The standard specimens were strips about 0.5-inch wide and 5 inches long which were bent 180 degrees around a 1-inch diameter mandrel and bolted in tension to the U-bend position. Time to crack initiation was observed by periodic examination (periods of about 24 hrs. to 48 hrs.) at 20× magnification. Complete failure due to severe cracking of a specimen would have been identifiable by loss of tension in the legs of the bend, or by fracture of the specimen. The corrosion tests other than the Huey tests were conducted for total times of 720 hours each. At that time the U-bend tests were discontinued; specimens which continued to exert tension at the end of the 720-hour exposure and whereon initiation of cracking was observed at the end of the test were reported as Not Failed, with a time-to-crack of 720 hours. Nondearerated caustic was used for the tests.

Huey Tests were conducted according to ASTM procedure A262-64T.

Results of stress-corrosion-cracking tests of alloys 1 through 5 in boiling 50% (by weight) sodium hydroxide solutions (aqueous) were that: duplicate U-bend specimens of each of these alloys survived the 720-hour test, thus None Failed; alloys 1, 2 and 5 had No Cracks; and alloys 3 and 4 showed incipient cracking, the time-to-crack being considered to be 720 hours.

Alloys 1, 2 and 3 were also tested in duplicate for stress-corrosion-cracking in hot caustic-chloride solutions. Results of 720-hour tests in solutions containing 30% sodium hydroxide plus 15% sodium chloride at 290°–500° F were that alloys 1, 2 and 3 had No Failures and No Cracking.

Successful stress-corrosion resistance was also experienced in boiling magnesium chloride solutions. With 720-hour tests in boiling 45% $MgCl_2$ solutions, results of U-bend specimens tested in duplicate were that alloys 1 through 5 survived successfully with No Failures and No Cracking.

In polythionic acid at 70° F., duplicate U-bends of alloy 5 survived with No Failures and No Cracking at the end of 720 hours.

Results of general corrosion tests for corrosion rates of cold-rolled strip specimens in the 1800° F.-annealed condition in boiling caustic solutions at 50% and 70% NaOH concentrations confirmed that the alloy of the invention provides satisfactory resistance to general corrosion in caustic, inasmuch as at 50% NaOH concentration the corrosion rates were less than 1.5 mpy(-mils per year), at at 70% NaOH concentration all the rates were less than 15 mpy.

Corrosion was measured by weight change. Mil (0.001-inch) per year rates are based on average rates during immersion periods of 720 hours.

Resistance to nitric acid is beneficial and worth noting. Huey test results, set forth in Table II, of testing cold-rolled 1800° F.-annealed strip of the invention after a sensitizing type of treatment show good resistance to intergranular attack in nitric acid.

TABLE II

| Alloy No. | Heat Treat | Nitric Acid (Huey) Test Results — Period (Rates of inch per month) 1 | 2 | 3 | 4 | 5 | Average |
|---|---|---|---|---|---|---|---|
| 1 | A | 0.0028 | 0.0039 | 0.0057 | 0.0065 | 0.0062 | 0.0050 |
| 2 | B | 0.0004 | 0.0007 | 0.0011 | 0.0017 | 0.0020 | 0.0012 |
| 3 | A | 0.0030 | 0.0052 | 0.0052 | 0.0048 | 0.0058 | 0.0048 |
| 4 | A | 0.0006 | 0.0010 | 0.0019 | 0.0034 | 0.0032 | 0.0020 |
| 5 | A | 0.0010 | 0.0016 | 0.0020 | 0.0028 | 0.0027 | 0.0020 |

Cold-rolled strip specimens heat treated:
A - ½ hour at 1800° F., Air Cool, plus 1 hour at 1250° F., Air Cool
B - 20 Min. at 1800° F., Air Cool, plus 1 hour at 1200° F., Air Cool Corrosion resistance of products of the invention to acids is not confined to nitric acid. Accelerated testing, wherein a corrosion rate of 133 mpy resulted when 1800° F.-annealed strip of alloy 4 was tested in 95% sulfuric acid at 210° F., indicated useful resistance to sulfuric acid corrosion in less severe conditions. Also, as mentioned hereinbefore, the alloy showed good resistance to polythionic acid. However, hydrochloric acid tests did not show good resistance.

Benefits for resisting corrosive attack where sulfur and other materials contaminate caustic media was shown by tests of general corrosion resistance and stress-corrosion-cracking resistance in boiling 50% sodium hydroxide solutions containing small amounts, such as 0.1% or 0.3%, of sulfur, sodium chloride, sodium carbonate and sodium sulfate.

Test results set forth in Table III confirm that the invention provides products having good strength and ductility for production of chemical industry apparatus with results of room temperature tensile testing of 0.125-inch thick strip specimens of the alloy products in the 1800° F.-annealed (multiphase) condition of 0.2% offset yield strength (YS) and ultimate tensile strength (UTS) in ksi (1000-pound kips per square inch) and percent tensile elongation (Elong., %) and also Rockwell hardness ($R_b$ and $R_c$). It is observed that all five of the strip products had yield strengths above 50,000 psi and elongations above 20%, and the products of alloys 1, 2 and 3, containing at least 2%, or about 2.2% or more, aluminum had yield strengths greater than 70,000 psi.

TABLE III

| Alloy No. | Mechanical Properties at Room Temperature — YS (ksi) | UTS (ksi) | Elong. (%) | Hardness |
|---|---|---|---|---|
| 1 | 73.0 | 130.6 | 25 | Rb 100 |
| 2 | 71.4 | 133.3 | 22 | Rc 24 |
| 3 | 74.3 | 135.3 | 25 | Rc 26 |
| 4 | 58.0 | 112.7 | 30 | Rb 93 |
| 5 | 62.1 | 119.3 | 29 | Rb 96 |

Evaluations of weldability were made by the TIG (tungsten-inert gas) method and showed strip products of the invention to have good weldability characteristics, including resistance to weld-metal hot-cracking in restrained conditions.

The alloy retains strength and ductility when heated to elevated temperatures such as 600° F. and 1000° F. However, service conditions above 1000° F. should generally be avoided inasmuch as tests for metallurgical stability while the alloy was held 100 hours at 1300° F. showed severe embrittlement.

The present invention is particularly applicable to providing wrought products, including strip, sheet, plate, tubing and other mill products, for caustic chemical plant equipment and is specially beneficial for overcoming difficulties of stress-corrosion-cracking of other metals in caustic and/or chloride media. Also, products of the invention can be useful for making structures that are subjected to acid environments. Moreover, it is also beneficial that products of the invention can be used for making welded structures. And it is important to note that the invention is applicable for overcoming expenses, e.g., capital costs, of building corrosion-resistant apparatus with metals that have more costly alloy content or necessitate more costly fabricating expenditures.

While the invention is mostly referred to herein in terms of wrought products, the invention also contemplates cast-to-shape articles made of the alloy of the invention, and it is to be understood that for making castings one may prefer to use special techniques, e.g., inert gas protection or vacuum melting and casting, to protect the molten alloy against excessive oxidation.

Although the present invention has been described in conjunction with preferred embodiments, it is to be understood that modifications and variations may be restorted to without departing from the spirit and scope of the invention, as those skilled in the art will readily understand. Such modifications and variations are considered to be within the purview and scope of the invention and appended claims.

I claim:

1. An alloy consisting essentially of 18% to 30% nickel and 20% to 30% chromium with the nickel-to-chromium ratio of up to 1.0, 1.7% to about 3% aluminum, 1% to about 5% copper, 0.03% to 0.08% carbon, up to 0.6% silicon, up to about 1.5% manganese, up to 0.06% calcium and balance essentially iron in an amount at least 44% of the alloy.

2. An alloy as set forth in claim 1 having a nickel-to-chromium ratio of 0.6 to 0.8.

3. An alloy as set forth in claim 1 wherein the nickel content is 18% to 24% and the chromium content is 22.5% to 30%.

4. An alloy as set forth in claim 1 wherein the aluminum content is 1.7% to 2.2%.

5. An alloy as set forth in claim 1 wherein the copper content is 1% to 1.8%.

6. An alloy as set forth in claim 1 containing 18% to 20% nickel, 25% to 28% chromium, 1.7% to 2.2% aluminum and 1% to 1.8% copper.

7. An alloy as set forth in claim 1 containing about 19% nickel, about 26% chromium, about 2% aluminum, about 1.4% copper, about 0.75% manganese and about 0.3% silicon.

8. A product composed of the alloy set forth in claim 1 and characterized by a wrought metal microstructure.

9. An annealed wrought product composed of the alloy set forth in claim 1 and having a grain size of ASTM 8 to ASTM 10.

10. A cold-worked and annealed metal product composed of the alloy set forth in claim 1 and characterized by a multiphase microstructure.

11. An alloy as set forth in claim 1 wherein any presence of molybdenum does not exceed 0.2% molybdenum.

* * * * *

UNITED STATES PATENT OFFICE

CERTIFICATE OF CORRECTION

PATENT NO. : 4,050,928

DATED : September 27, 1977

INVENTOR(S) : JAMES ROY CRUM

It is certified that error appears in the above-identified patent and that said Letters Patent are hereby corrected as shown below:

Column 2, line 61, for "here" read --herein--.

Column 5, line 39, first occurrence, for "at" read --and--.

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*